United States Patent [19]

Harada

[11] Patent Number: 4,939,484

[45] Date of Patent: Jul. 3, 1990

[54] TRANSMISSION CHANNEL COUPLER FOR ANTENNA

[75] Inventor: Takuji Harada, Hiratsuka, Japan

[73] Assignee: Harada Kogyo Kabushiki Kaisha, Tokyo, Japan

[21] Appl. No.: 432,343

[22] Filed: Nov. 6, 1989

Related U.S. Application Data

[63] Continuation of Ser. No. 45,622, May 1, 1987, abandoned.

[30] Foreign Application Priority Data

Sep. 24, 1986 [JP] Japan ..... 61-147067[U]

[51] Int. Cl.[5] ..... H01P 5/02; H01P 7/00; H01Q 1/27

[52] U.S. Cl. ..... 333/24 R; 333/219; 333/222; 343/715

[58] Field of Search ..... 333/24 R, 219, 222; 343/715

[56] References Cited

U.S. PATENT DOCUMENTS

| | | | |
|---|---|---|---|
| 2,829,367 | 4/1958 | Rychlik | 343/850 |
| 3,939,443 | 2/1976 | Biré et al. | 333/24 C |
| 4,238,799 | 12/1980 | Parfitt | 343/745 |
| 4,342,969 | 8/1982 | Myers et al. | 333/219 |
| 4,611,243 | 11/1985 | Harada | 333/24 C |
| 4,613,833 | 9/1986 | Harada | 333/24 C |
| 4,621,243 | 11/1986 | Harada | 333/219 |

*Primary Examiner*—Rolf Hille
*Assistant Examiner*—Hoanganh Le
*Attorney, Agent, or Firm*—Koda & Androlia

[57] ABSTRACT

Inductance coupling type transmission channel couplers mounted on either side of an insulator such as window glass of a vehicle including a pair of resonator, each including a cylindrical outer conductor and a helical conductor coaxially provided in the outer conductor with one end connected thereto. The resonant frequency of the tuning inductance circuit thus constructed is set at ⅓ of an objective frequency, and the ratio between the inner diameter and the outer diameter of the helical conductor is set at 1.1–2.0.

3 Claims, 3 Drawing Sheets

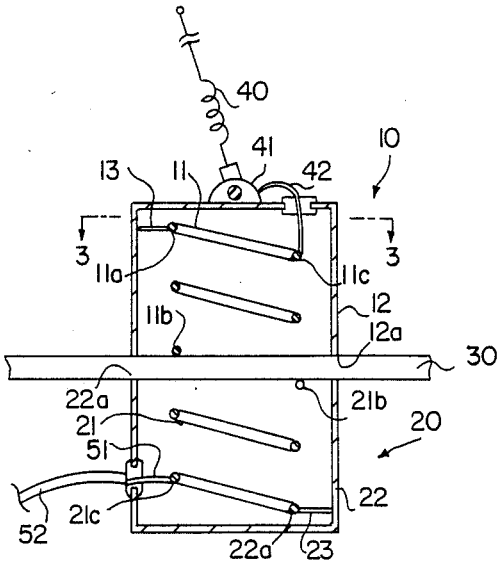
FIG. 1
FIG. 2
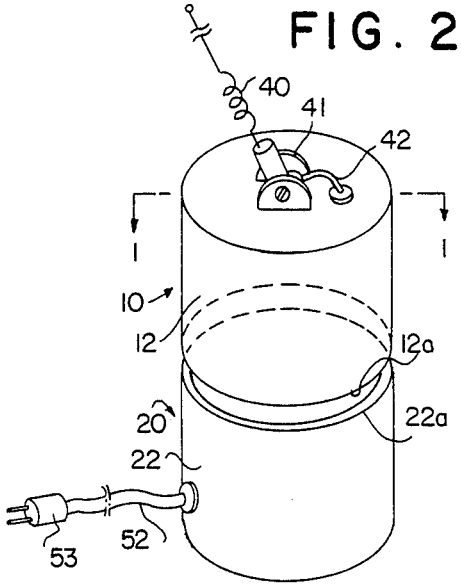
FIG. 3
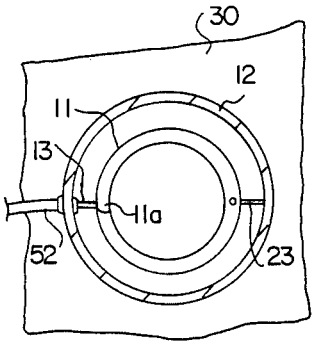

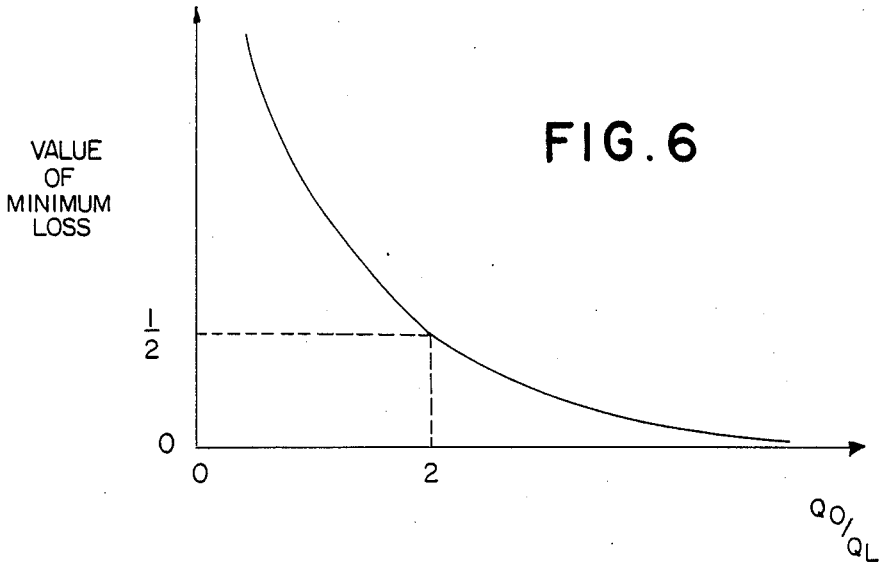
FIG. 6
FIG. 7
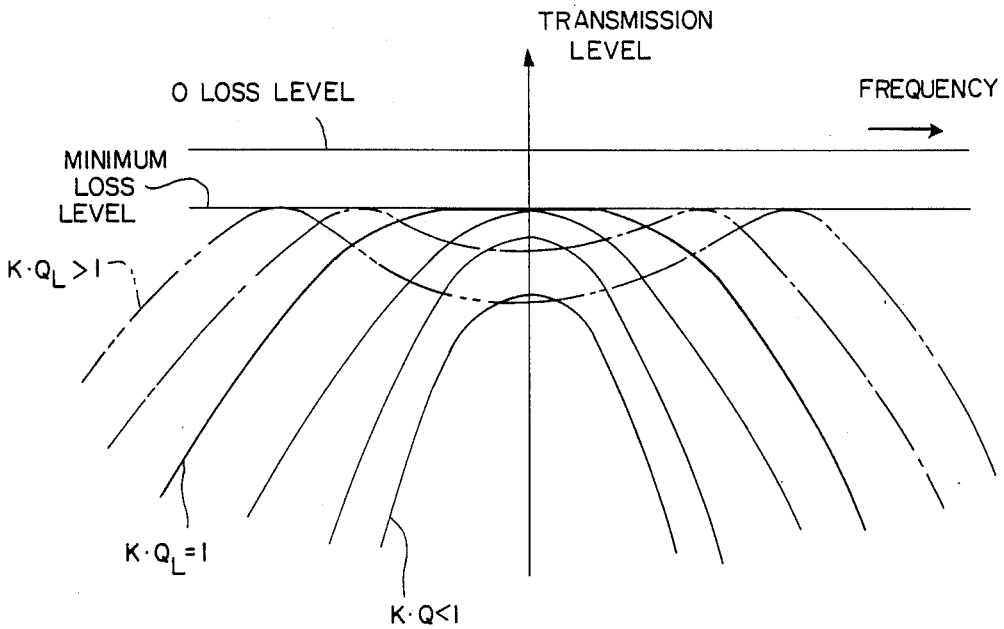

TRANSMISSION CHANNEL COUPLER FOR ANTENNA

This is a continuation of application Ser. No. 045,622, filed May 1, 1987 now abandoned.

BACKGROUND OF THE INVENTION

1. Field of the Invention

This invention relates to an antenna coupler for vehicles and more particularly to a coupler mounted on insulator without damaging it for transmitting high frequency signals.

2. Prior Art

For transmitting high frequency signals through an insulator such as glass, etc. it is preferable to install a signal transmitting device which does not damage the insulator. For instance, when connecting communication equipment in an automobile to an antenna provided outside of the automobile, it is desirable to provide the antenna without damaging the automobile body or the window glass thereof.

An inductance coupling type transmission channel coupler for antennas is one which meet the above mentioned requirement. In this coupler, glass is sandwiched by a pair of loop coils such that electromagnetic coupling is made between the two loop coils. The advantage of this device is that the transmission loss is relatively low and the frequency characteristics are even.

In order to obtain an antenna having good antenna characteristics, it is necessary to increase the coupling strength the inductive coupling of the transmission channel coupler. On the other hand, the coupler must be small in size so that it is usable for vehicles, otherwise it cannot meet such usage. However, if the coupler is designed small, the coupling coefficiency of the inductive coupling becomes too small to obtain the predesignated antenna performance.

SUMMARY OF THE INVENTION

The present invention was made in view of the problems of the prior art couplers.

The primary object of the present invention is to provide a small sized transmission channel coupler used for antennas which allows high frequency signals to be transmitted through an insulator while keeping the antenna performance at a certain desirable level and which can be installed without damaging the isulator.

In keeping with the principles of the present invention, the objects are accomplished with a unique transmission channel coupler including a pair of resonators which are substantially the same in structure and mounted on either side of an insulator such as glass, etc., each resonator comprising a cylindrical outer conductor, a helical conductor which is coaxially provided in the outer conductor, and a conducting wire which connects the helical conductor to the outer conductor. The resonant frequency of the resonators is set at ⅓ of the objective frequency to form a tertiary high harmonic resonance circuit so that the coupling coefficient and resonant Q factor can be improved about 10% as compared with the prior art channel couplers.

BRIEF DESCRIPTION OF THE DRAWINGS

The above mentioned features and objects of the present invention will become more apparent with reference to the following description taken in conjunction with the accompanying drawings wherein like reference numerals denote like elements and in which:

FIG. 1 is a longitudinal sectional view taken along the line 1—1 of FIG. 2 showing one of the embodiments of the present invention;

FIG. 2 is perspective view of the coupler of the present invention;

FIG. 3 is a cross sectional view taken along the line 3—3 of FIG. 1;

FIG. 6 is a graph showing the loss level in relation to QO/QL; and,

FIG. 7 is a graph showing the varied loss levels which occur when K·QL are changed.

DETAIL DESCRIPTION OF THE INVENTION

Figure 4:
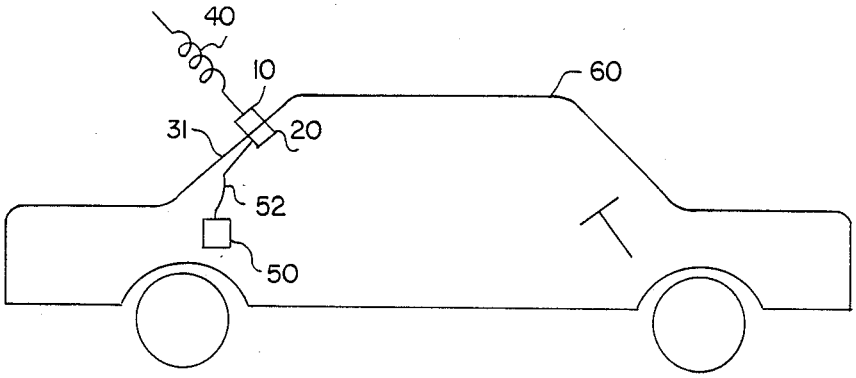
FIG. 4 is a view illustrating an example of the above embodiment mounted on an automobile.

In the accompanying drawings, FIG. 2 is a perspective view showing an embodiment of the present invention, FIG. 1 is a longitudinal cross sectional view taken along the line 1—1 of FIG. 2, and FIG. 3 is a lateral cross sectional view taken along the line 3—3 of FIG. 1.

In this embodiment, a first resonator 10 and a second resonator 20 are disposed to face each other on the either side of a glass 30. The first resonator 10 includes a helical conductor 11, an outer conductor 12, and a conducting wire 13.

The helical conductor 11 is a conductor of a helical form and has one end **11*a* grounded to the outer conductor 12. Another end 11*b* of the helical conductor 11 is kept in contact with the glass 30, and a tapping position 11*c* of the conductor 11 is connected to an antenna element 40. The end 11*b* of the helical conductor 11 and the outer conductor 12** are kept in an open state. But they may be held separated with a capacitance less than several picofarads.

The outer conductor 12 is disposed outside of the helical conductor 11 such that these two conductors are nearly coaxial with each other. The shape of the outer conductor 12 may be a cylindrical column, angular column, etc.

The conducting wire 13 is a single member and has two different functions. One is a connecting function and the other is a conductor positioning function. In particular, the conducting wire 13 electrically connects the one end **11*a* of the helical conductor 11 to the inner wall of the outer conductor 12. The conducting wire 13 also positions the other end 11*b* of the helical conductor 11 within the area defined by the end of the outer conductor 12**.

The antenna element 40 is connected to a tapping point **11*c* of the helical conductor 11 through antenna seat 41 and antenna leader line 42. The antenna seat 41 is insulated from the outer conductor 12**.

The second resonator 20 has the same structure as the first resonator 10 and includes a helical conductor 21, an outer conductor 22, and a conducting wire 23. The helical conductor 21, the outer conductor 22 and the conducting wire 23 are respectively the same as the helical conductor 11, the outer conductor 12, and the conducting wire 13. One end **11*a* and the other end 11*b* of the helical conductor 11 and the end surface 12*a* of the outer conductor 12 respectively correspond to one end 21*a* and the other end 21*b* of the helical conductor 21 and the end surface 22*a* of the outer conductor 22**. Furthermore, the function of each element of the second resonator 20 is the same as that of the elements of the first resonator 10. The tapping points 11c and 21c are adjustable in accordance with outside impedance.

The first resonator 10 and the second resonator 20 are coaxially secured on either side of the glass 30. More specifically, the end surface 12a of the outer conductor 12 is secured on one side of the glass 30 and the end surface 22a of the outer conductor 22 is secured on the other side of the glass 30 such that the helical conductors 11 and 21 are in a coaxial relation with each other and so are the outer conductors 12 and 22. The resonators 10 and 20 may be secured ont he surfaces of the glass 30 by any desirable method.

The inner diameters of the outer conductors 12 and 22 must be almost the same, but the wall thickness of the outer conductors 12 and 22 can be different from each other.

A leader wire 51 connects the tapping point 21c of the helical conductor 21 to a connecting cable 52 of the communication equipment of an automobile. A connector 53 is linked to the forward end of the leader wire 51.

Furthermore, the resonant frequency of each resonator 10 and 20 is set approximately one third (⅓) of the objective frequency. In other words, a tertiary high harmonic resonant circuit is formed by the resonators 10 and 20. In this case, with the broader bandwidth, it is possible to take a larger difference in the resonant frequency.

In the meantime, the glass 30 and the helical conductors 11 and 21 are omitted in FIG. 2.

The function of the above embodiment of this invention will be described below.

FIG. 4 illustrates an example of the transmission channel coupler of this invention mounted on a vehicle.

Facing each other, the first resonator 10 and the second resonator 20 are mounted to sandwich the window glass 31 of an vehicle 60. These resonators are positioned coaxially. To the first resonator, the antenna element 40 is connected. Communication equipment 50 is installed in the vehicle 60, and this communication equipment 50 is connected to the second resonator 20 through the connecting cable 52.

With the above arrangement, magnetic field leaks between the first and second resonators 10 and 20, and a necessary Q factor (quality factor) and coupling coefficient K are obtained, and the transmission loss can be reduced. Also, the resonant frequency of the resonators 10 and 20 are set approximately ⅓ of the objective frequency. Accordingly, compared with the fundamental wave resonance at the object frequency, the Q factor and the coupling coefficiency K becomes larger, and the connection between the two resonators can be more tight.

More specifically, in the present invention, the helical conductor 11 (or 21) and the outer conductor 12 (or 22) are disposed coaxially. Accordingly, the Q factor at no load (hereunder called "unloaded Q" and shown by "QO") can be increased. The value of this QO is several times higher than the ordianry loop coil. In other words, the ordinary loop coil has a QO value of about 200, but the first and the second resonators of the present invention have a QO value of over 1,000. On the other hand, the Q factor with load (hereunder called "loaded Q" and shown by "QL") can be decided automatically when the frequency band is fixed, and the values of QL of the ordinary loop coil and the resonators of the above embodiment are identical. As a result, the value of QO/QL in the embodiment of the present invention is several times larger than that of the ordinary loop coil.

As the value of QO/QL becomes larger, the transmission loss becomes smaller as shown in FIG. 6. Thus, in the above embodiment the transmission efficiency is higher than the case wherein a regular loop coil is used.

Also, since the resonant frequency of each resonator 10 or 20 is set at approximately Δ of the objective frequency, the coupling coefficiency K and the resonant Q factor are improved more than 10% respectively compared with the resonace of the fundamental harmonic and improved over 20% in overall coupling strength. Conversely, as long as the characteristic wherein the tertiary high harmonic resonance is not conducted can be retained, the overall size of the coupler can be minimized more than 20%.

Usually, the helical resonators are regarded as a variation of cavity resonators. Accordingly, the coupling coefficient K does not increase in value even if the resonators are installed close to each other. However, in the above embodiment, the end 11b or 21b of the helical conductos is fixed within the area defined by the end face 12a or 22a of the outer conductor, and this area is firmly placed on the glass 30. Thus, the coupling coefficient K for coupling the first and the second resonators 10 and 20 becomes larger in value.

Also, in the above embodiment when the antenna element 40 and the communication equipment 50 are connected, the value QL of the first resonator 10 and the value QL of the second resonator 20 are set almost identical.

Further, the first and second resonators 10 and 20 are shaped such that the equation $K \cdot QL = 1$ can be established wherein K is a coupling ocefficient of the first and second resonators 10 and 20. The equation $K \cdot QL = 1$ is for the purpose of broadening the frequency band.

FIG. 7 illustrates the changes in loss level in relation with the frequency with the values of K·QL varied.

As seen from FIG. 7, within the range $K \cdot QL < 1$ (shown by fine solid lines), the loss level exceeds the minimum loss level, and if the value of K·QL is set small, the loss level gradually increases. On the other hand, within the range $K \cdot QL > 1$ (shown by the dotted lines and double dotted lines), there are two regions of the minimum loss levels. Within the band between the two regions, the loss is large, and if the value of K·QL increases, the loss is gradually increased. Contrary thereto, if $K \cdot QL = 1$ (shown by the fat solid lines), the band width at the minimum loss level is wider.

In the above embodiment, $K \cdot QL = 1$ can be achieved, and in this case QL is not so much larger than QO. As a result, as mentioned above, the transmission loss can be reduced. In the prior art which uses loop coils, it is impossible to accomplish $K \cdot QL = 1$, and with the adjustments made to the position of the tapping, $K \cdot QL = 1$ may be accomplished. However, in this case the value QL is larger than QO, and thus the value QO/QL is decreased. As a result, as seen in FIG. 6, in the prior art the transmission loss was increased.

Figure 5:
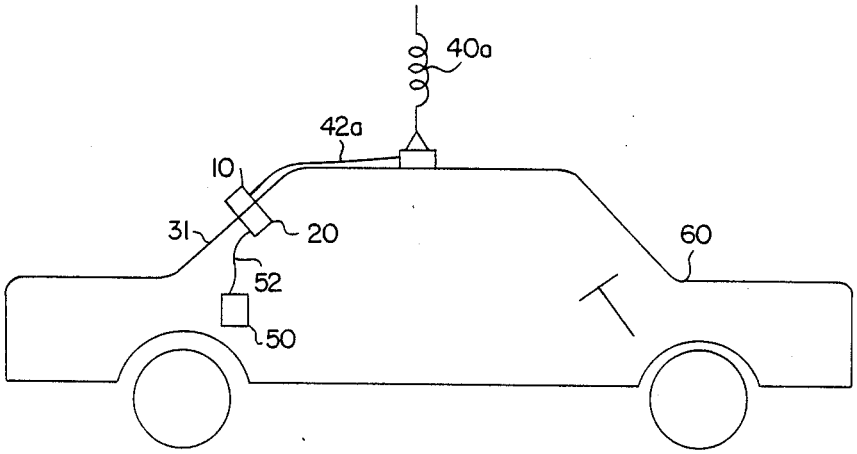
FIG. 5 is a view illustrating another example of the above embodiment mounted on an automobile.

Incidentally, as shown in FIG. 5, the antenna element 40a may be mounted on the roof of the vehicle 60 with the use of a long antenna connecting cable 42a.

It is preferable that the ratio of the inner diameter of the outer conductor 12 or 22 of the first or second resonator and the outer diameter of the helical conductor 11 or 21 of the first or second resonator is set at 1.1–2.0. If the outer conductor 12 or 22 is sylindrical in shape, such ratio is preferably 1.2–2.0, and if the outer conductor 12 or 22 is angular column in shape, it is preferable to set the ratio at 1.1–1.8.

The helical conductor 11 in the first resonator 10 and the helical conductor 21 in the second resonator 20 are coiled in the same direction. The reason for this is that the same coiling direction creates an electrostatic effect, and as a result, the actural coupling coefficient K between the first and second resonators 10 and 20 can be increased. However, the coiling directions of the helical conductors 11 and 21 may be opposite.

Also, instead of using the helical conductors 11 and 21 which make connections at the tapping positions 11*c* and 21*c*, the so-called close coiling bifilar coil can be used if it is formed by closely and separately winding two helical conductors used for input/output and tuning, respectively.

Further, not only glass but also an adhesive tape, a protective insulator, etc. may be interposed between the first and second resonators 10 and 20.

In the above embodiment, a window glass of a vehicle is used for explaining the glass 30 on which the coupler of this invention is mounted. However, the glass 30 can be of any other type such as window glass used in a building. Also, instead of the glass 30, other types of insulators may be used. Furthermore, the shape of the coupler of this invention is not limited to those shown in FIGS. 1–3. Couplers with other shapes and structure than those shown in Figures can be used in the present invention.

As seen for the above, according to the present invention, the couplers can be mounted on an insulator without damanging it and transmit high frequency signals, keeping with a certain level of high performance. Also, it can be manufactured to be small in size.

It should be apparent to those skilled in the art that the above described embodiments are merely illustrations of the many possible specific embodiments which represent the application of the principles of the present invention. Numerous and various other arrangements can be readily devised by those skilled in the art without departing from the spirit and scope of the invention.

I claim:

1. An inductance coupling type transmission channel coupler comprising:

a helical conductor;

an outer conductor provided outside of said helical conductor, said outer conductor being coaxial with said helical conductor;

a means for electrically connecting one end of said helical conductor to an inner wall of said outer conductor; and a conductor fixing means for fixing an other end of said helical conductor within a plane defined by the end surface of said outer conductor; and wherein a ratio between the inner diameter of said outer conductor and the outer diameter of said helical conductor is in the range of 1.1 to 2.0; and said helical conductor and said outer conductor form a helical resonator having a resonant frequency of one third of a frequency of transmission of said transmission channel coupler.

2. An inductance coupling type transmission channel coupler comprising:

a helical condcutor;

an outer conductor provided outside of said helical conductor, said outer conductor being coaxial with said helical conductor;

a means for electrically connecting one end of said helical conductor to an inner wall of said outer conductor; and a conductor fixing means for fixing an other end of said helical conductor within a plane defined by the end surface of said outer conductor; and wherein said helical conductor and said outer conductor form a helical resonator having a resonant frequency of one third of a frequency of transmission of said transmission channel coupler.

3. A inductance coupling type transmission channel coupler comprising:

a helical conductor;

an outer conductor provided outside of said helical conductor and surrounding said helical conductor, said outer conductor being coaxial with said helical conductor and being electrically coupled to said helical conductor; and wherein said helical conductor and said outer conductor form a helical resonator having a resonant frequency of one third of a frequency of transmission of said tansmission channel coupler;

whereby a quality factor Q and a coupling coefficient K of said transmission channel coupler is increased.

* * * * *